US005520426A

United States Patent [19]

Arabia, Jr. et al.

[11] Patent Number: 5,520,426

[45] Date of Patent: May 28, 1996

[54] VEHICLE DOOR LATCH WITH INTEGRAL PILLAR DAMPENER

[75] Inventors: Frank J. Arabia, Jr., Shelby Township; Thomas A. Dzurko, Macomb; Dennis C. Andrix, Rochester, all of Mich.

[73] Assignee: General Motors Corporation, Detroit, Mich.

[21] Appl. No.: 304,078

[22] Filed: Sep. 12, 1994

[51] Int. Cl.[6] ..... E05B 9/00

[52] U.S. Cl. ..... 292/337; 292/216; 292/341.12; 292/DIG. 73

[58] Field of Search ..... 292/337, DIG. 73, 292/DIG. 56, DIG. 38, 341.12, 216, 210

[56] References Cited

U.S. PATENT DOCUMENTS

| | | | |
|---|---|---|---|
| 1,277,126 | 8/1918 | Rixson | 292/337 |
| 3,371,948 | 3/1968 | Velavicius | 292/341.12 X |
| 3,705,738 | 12/1972 | Yoshimura | 292/341.12 X |
| 4,130,308 | 12/1978 | Jeavons | 292/341.12 X |
| 4,575,138 | 3/1986 | Nakamura et al. | 292/337 X |
| 4,854,617 | 8/1989 | Hayakawa et al. | 292/216 |

FOREIGN PATENT DOCUMENTS

| | | | |
|---|---|---|---|
| 136370 | 12/1919 | United Kingdom | 292/337 |

*Primary Examiner*—Rodney M. Lindsey
*Attorney, Agent, or Firm*—Jeffrey A. Sedlar

[57] ABSTRACT

Objectional vehicle door opening and closing sounds are eliminated by dampening vibration in the vehicle door system. An integral dampener is positioned to engage the bolt of the door latch assembly reducing the resonation of the door opening's frame caused by release of the striker from the latch bolt. The integral dampener frictionally engages the bolt for an initial opening and final closing portion of the linear travel of the door. Once initial opening has occurred and the striker has returned to its normal door-open, no-load position, the integral dampener disengages from the bolt and the latch assembly operates in a conventional manner.

3 Claims, 3 Drawing Sheets

VEHICLE DOOR LATCH WITH INTEGRAL PILLAR DAMPENER

BACKGROUND OF THE INVENTION

This invention relates to vehicle doors.

A conventional vehicle is constructed with a plurality of openable doors. Each door is typically mounted on hinges within a door opening. The frame of a door opening generally includes a resilient weatherstrip, which provides a seal when the door is closed. Each door also includes a latch that generally engages a striker mounted on the door opening frame to releasably hold the door in a closed position.

When a door is fully closed to its primary latched position, the door opening's weatherstrip is compressed, applying an outboard load on the door. This in turn forces the door outward, causing the door latch to apply an outwardly directed load on the striker. The outward seal force load in combination with compliancy of the striker mounting surface results in an outward striker displacement when the door is fully closed as compared to its door-open, no-load position.

The energy stored in the displaced striker is released the instant the door latch mechanism is unlatched to open the door. This results in vibration of the striker assembly and resonation of the striker mounting surface on the vehicle door opening frame. The resultant resonation and accompanying sound generated thereby can be objectionable from the standpoint of perceived vehicle quality.

The sound made by a vehicle's door when opening and closing is a characteristic often identified with the quality of a vehicle's construction. Therefore, the quality of the sound generated by the opening and closing of all doors is important. It is known that rear doors commonly have a lower quality door closing and opening sound characteristic than front doors. The lower quality opening sound generated by rear doors is partially due to the higher compliancy exhibited by the striker mounting surface on the rear door frame as compared to that of a front door.

Conventionally, the resonation, which generates objectionable sound upon opening a door, is eliminated or reduced by reinforcing the vehicle door opening frame. With rear doors, reinforcements are welded at the back-body pillar to reduce the compliance of the vehicle door frame. Optionally, or in addition to adding reinforcement, vibration dampening pads may be added to the door opening frame to attenuate objectionable sounds.

This conventional method of addressing the problem is somewhat costly. Therefore, an improved method of dampening the vehicle door opening pillar vibration to attenuate the associated sound is required.

SUMMARY OF THE INVENTION

It has been determined that approximately 60% of the noise generated during vehicle door opening and closing is attributable to the door latch mechanism. The remaining approximately 40% is due to the overall vehicle door system construction. This invention is targeted at eliminating objectionable sounds that result from the vehicle's door system construction. This invention addresses the problem of vehicle door opening vibration generated sound by redesigning the latch assembly to eliminate vibration rather than attempting to further strengthen and dampen resonation of the door opening frame itself after vibration occurs.

A conventional latch assembly includes a bolt which is a movable member that engages the vehicle door opening striker to releasable latch the door closed. This invention is directed to the addition of frictional force to the bolt of a latch assembly. The frictional force is applied by means of an integral dampener that engages the bolt for approximately the initial 2.5 mm of linear outboard directed door travel when opening and the final 2.5 mm of linear inboard directed door travel when closing.

The dampener prevents the bolt from initially snapping out of engagement with the striker when unlatching and therefore, prevents an initial trigger release of the striker. By maintaining an initial contact between the bolt and striker, the striker is dampened by the latch and door assembly and allowed to return from a displaced position to its door-open, no-load position without the vibration conventionally exhibited.

After approximately the initial 2.5 mm of linear outboard travel of the door is complete, the integral dampener releases the bolt to its normal operating condition. Therefore, the latch's integral dampener provides a means of dampening and absorbing the stored energy released upon initial door opening without inhibiting the normal operation of the latch. Maintaining temporary, initial contact between the bolt and striker prevents vibration of the striker and resonation of the vehicle door opening frame, without the expense of welded reinforcements or dampening materials.

DETAILED DESCRIPTION OF THE PRESENTLY PREFERRED EMBODIMENT

Figure 1:
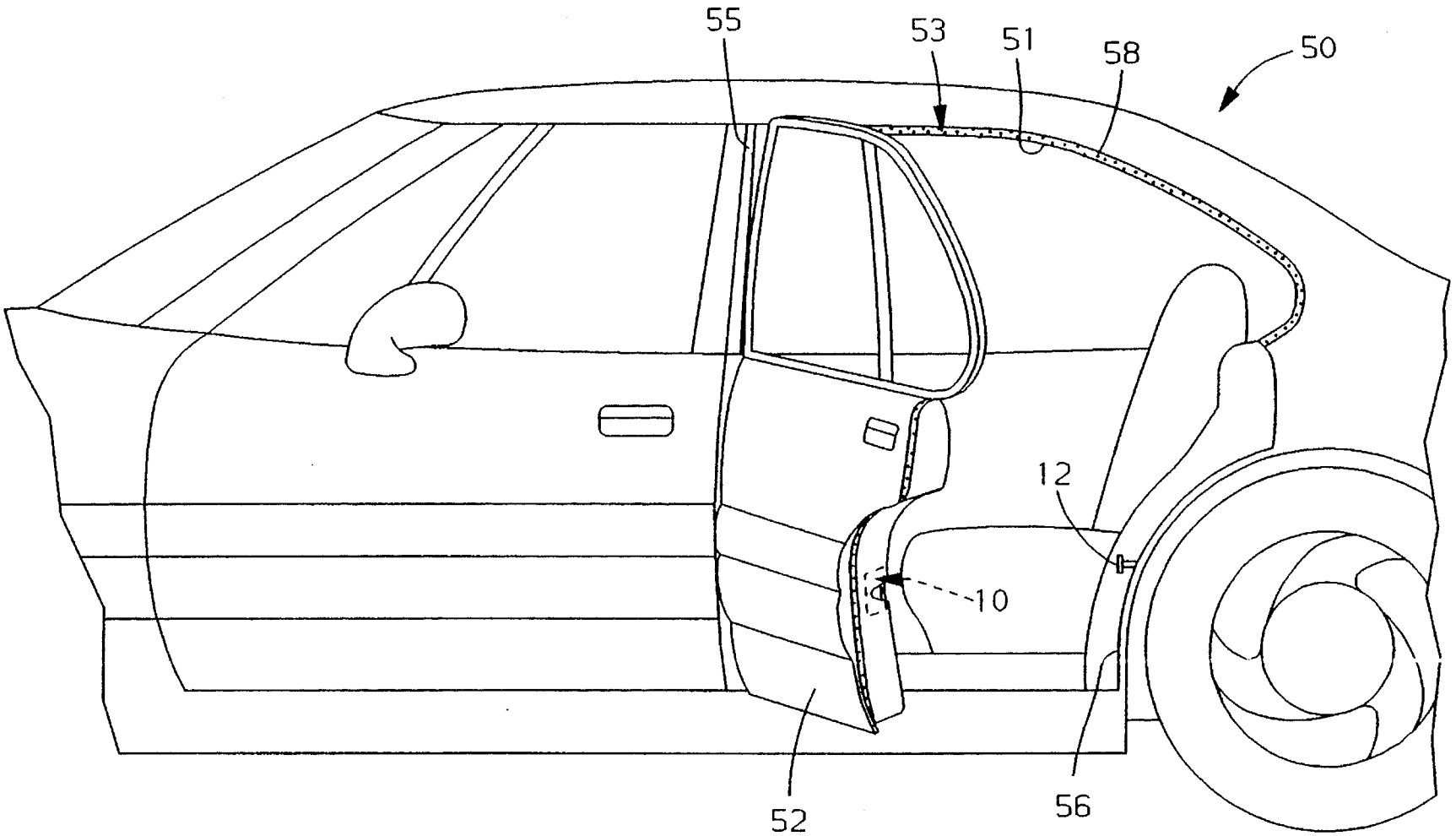
FIG. 1 is a perspective view of a vehicle's door opening area and door.

Referring to the drawings, FIG. 1 illustrates a vehicle designated generally as 50 which exhibits at least one door opening 51. Door opening 51 is surrounded by frame 53 which includes center pillar 55. Striker 12 is fixedly mounted on back-body pillar panel 56 and extends from frame 53 into door opening 51. Surrounding door opening 51 on frame 53 is weatherstrip 58 which presents a seal interposed between door frame 53 and door 52 when closed. When door 52 is fully closed to the primary latched position, the weatherstrip 58 applies an outboard load on door 52 which in turn, causes latch 10 to apply an outwardly directed force on striker 12.

Figure 2:
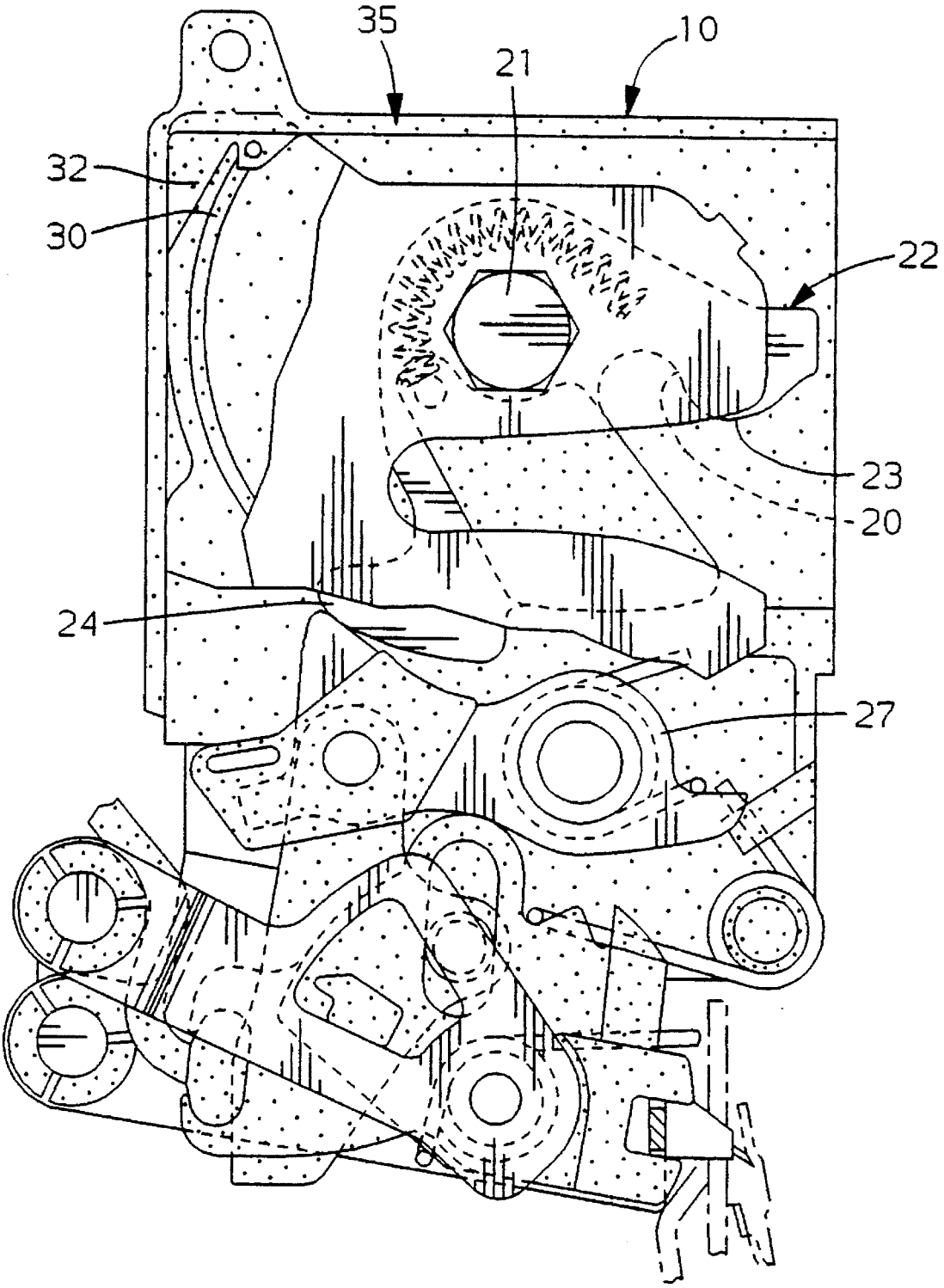
FIG. 2 is a detailed illustration of a latch assembly.

FIG. 2 illustrates latch 10 in greater detail. A detailed explanation of the mechanical components of a latch assembly can be found in U.S. Pat. No. 5,277,461 to Dzurko et al. which issued Jan. 11, 1994 and is commonly assigned.

Latch assembly 10 includes bolt 22 which is pivotally mounted on pin 21. Bolt 22 includes aperture 20 which receives striker 12 when vehicle door 52 is closed.

The closing of vehicle door 52 results in engagement between striker 12 and bolt 22. During closing, engagement results in clockwise rotation of bolt 22 as striker 12 enters aperture 20 and hook 23 captures striker 12. Closing of door 52 results in rotation of bolt 22 between the open unlatched position shown in FIG. 2 (and in phantom in FIG. 3), and the fully closed primary latched position shown in FIG. 3. When in the fully closed primary latched position, bolt 22 is held against rotation by detent lever 27, shown in FIG. 2.

Figure 3:
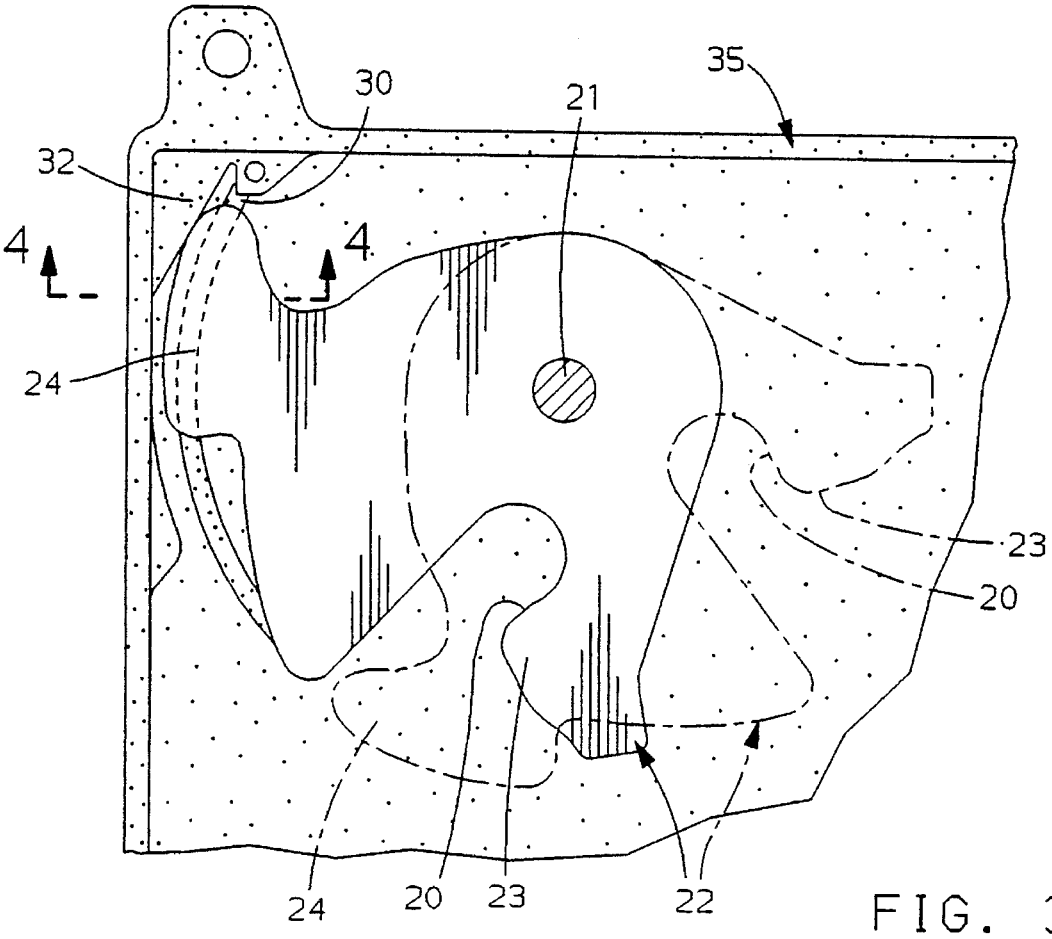
FIG. 3 is a detailed illustration of a latch assembly's integral dampener.

FIG. 3 illustrates the engagement between the door latch integral dampener and bolt 22. The integral dampener is comprised of projection 30 and abutment 32. Both projection 30 and abutment 32 are preferably integrally molded with plastic housing 35 and project therefrom. When in the fully closed primary latched position, bolt 22 engages the integral dampener comprising projection 30 and abutment 32 of housing 35.

Figure 4:
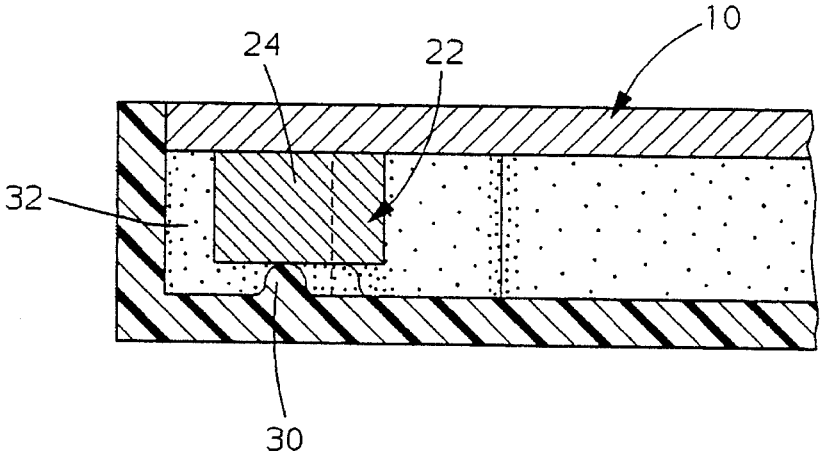
FIG. 4 is a sectional view taken general through the plane indicated by the line 4—4 in FIG. 3.

The rotation of bolt 22 causes foot 24 to engage projection 30 and abutment 32 for approximately 2.5 mm of linear travel of door 52 adjacent to the fully closed primary latched position. Projection 30 includes a ramped profile to provide sufficient frictional contact with foot 24 at a predetermined point in the rotation of bolt 22. As illustrated in FIG. 4, in the fully closed primary latched position projection 30 contacts foot 24 of bolt 22 causing friction to occur therebetween. In addition, foot 24 is cammed into engagement with abutment 32 to assist in dampening bolt 22 and striker 12.

When the latch 10 is unlatched, detent lever 27 disengages from the bolt 22, releasing it and permitting rotation. The frictional fit between foot 24 and projection 30 and between foot 24 and abutment 32 prevents bolt 22 from snapping to the open position. Therefore, bolt 22 moves toward the open position only in concert with the outwardly directed opening of door 52 and the movement of striker 12 from its compliant position to its door-open no-load position. Contact is maintained between striker 12 and bolt 22 during the initial opening of door 52. As striker 12 moves to its no-load position, maintained contact with bolt 22 prevents vibration from occurring and energy is dampened by being absorbed into door 52 from striker 12 through bolt 22. Vibration is avoided by inhibiting initial rotation of bolt 22 rather than instantly releasing striker 12 and allowing it to vibrate.

By absorbing the energy contained in striker 12, resonation of back-body pillar panel 56 is dampened and the objectionable sound associated therewith is eliminated.

What is claimed is:

1. A door latch for mounting in a door and engaging a striker to hold the door in a closed position comprising:

a housing;

a bolt at least partially mounted in the housing rotatable about an axis between a latched position and an unlatched position having a aperture shaped to receive the striker;

a spring biasing the bolt toward the unlatched position;

a projection on the housing engaging the bolt when in the latched position and for a portion of rotation adjacent thereto applying a first force to the bolt parallel to the axis inhibiting rotation thereof; and an abutment on the housing wherein the bolt is engaged with the abutment in a cam-like manner when in the latched position applying a second force to the bolt normal to the axis wherein the first and second forces prevent the spring from moving the bolt toward the unlatched position.

2. A door latch for mounting in a door and engaging a striker mounted in a no-load position on a vehicle door opening frame to hold the door in a closed position within the vehicle door opening frame comprising:

a housing;

a bolt mounted in the housing, rotatable between a latched position and an unlatched position having a side, an edge and an aperture shaped to receive the striker wherein when in the latched position the bolt applies an outwardly directed force displacing the striker and when in an unlatched position the striker returns to the no-load position;

a projection extending from the housing engaging the side of the bolt when in the latched position and for only an initial opening movement of the door the projection having a ramped profile applying a frictional force to the bolt wherein the projection inhibits initial rotation of the bolt and maintains contact between the bolt and the striker as the door is initially opened; and an abutment extending from the housing and engaging the edge of the bolt in a cam-like manner when in the latched position so that the projection and the abutment inhibit rotation of the bolt when released from the latched position maintaining contact between the bolt and the striker as the striker returns to the no-load position preventing vibration generation.

3. A door latch for mounting in an openable door and engaging a striker mounted in a no-load position on a vehicle door opening frame to hold the door in a closed position within the vehicle door opening frame comprising:

a housing mounted to the door;

a bolt mounted in the housing, rotatable between a latched position where the door is closed and an unlatched position where the door is open having a side, an edge and an aperture shaped to receive the striker wherein when in the latched position the bolt applies an outwardly directed force displacing the striker and when in an unlatched position the striker returns to the no-load position;

a projection extending from the housing and being part of the housing engaging the side of the bolt when in the latched position and for only an initial opening movement of the door the projection having a ramped profile applying a frictional force to the bolt wherein the projection inhibits initial rotation of the bolt and maintains contact between the bolt and the striker as the door is initially opened; and an abutment extending from the housing and engaging the edge of the bolt in a cam-like manner when in the latched position so that the projection and the abutment inhibit rotation of the bolt when released from the latched position corresponding to approximately 2.5 millimeters of an outwardly directed door travel away from the vehicle door opening frame, maintaining contact between the bolt and the striker as the striker returns to the no-load position preventing vibration generation.

* * * * *